US005326225A

United States Patent [19]

Gallivan et al.

[11] Patent Number: 5,326,225

[45] Date of Patent: Jul. 5, 1994

[54] HIGH EFFICIENCY, LOW AXIAL PROFILE, LOW NOISE, AXIAL FLOW FAN

[75] Inventors: William P. Gallivan; Haran K. Periyathamby; Alex S. Joseph, all of London, Canada

[73] Assignee: Siemens Automotive Limited, London, Canada

[21] Appl. No.: 91,074

[22] Filed: Jul. 12, 1993

Related U.S. Application Data

[63] Continuation of Ser. No. 884,968, May 15, 1992, abandoned.

[51] Int. Cl.[5] ..... F04D 29/38

[52] U.S. Cl. ..... 416/179; 416/169 A; 416/189; 416/DIG. 2

[58] Field of Search ..... 416/169 A, 179, 189, 416/192, 195, DIG. 2, DIG. 5

[56] References Cited

U.S. PATENT DOCUMENTS

| | | | |
|---|---|---|---|
| 3,842,902 | 10/1974 | Poslusny | 416/192 |
| 4,406,581 | 9/1983 | Robb et al. | 416/169 A |
| 4,505,641 | 3/1985 | Tsuchikawa et al. | 416/169 A |
| 4,548,548 | 10/1985 | Gray, III | 416/192 |
| 4,566,852 | 1/1986 | Hauser | 416/189 |
| 4,569,631 | 2/1986 | Gray, III | 416/169 A |
| 4,569,632 | 2/1986 | Gray, III | 416/189 |
| 4,684,324 | 8/1987 | Perosino | 416/189 |
| 4,685,513 | 8/1987 | Longhouse et al. | 416/192 |
| 4,900,229 | 2/1990 | Brackett et al. | 416/189 |
| 4,930,984 | 6/1990 | Kesel et al. | 416/189 |
| 5,183,382 | 2/1993 | Carroll | 416/169 A |

*Primary Examiner*—John T. Kwon

*Attorney, Agent, or Firm*—George L. Boller; Russel C. Wells

[57] ABSTRACT

The fan blades have a particular geometry that combines high efficiency, low axial profile, and low noise in an axial flow fan. The fan also comprises a circular outer band that coacts with a surrounding shroud structure to form a labyrinth air seal. The shroud structure comprises two parts that cooperatively define a radially inwardly open groove within which a flange of the fan band is received to form the labyrinth seal.

2 Claims, 5 Drawing Sheets

| SECTION (FRONT VIEW) | R (mm) | C (mm) | θ (deg) | ε (deg) | Y OFFSET (mm) | SKEW (deg) |
|---|---|---|---|---|---|---|
| A | 72.5 | 63 | 42 | 71.7 | 0 | -4.3 |
| B | 84.5 | 68 | 27 | 75.6 | 0 | -1.8 |
| C | 96.5 | 65 | 19 | 75.9 | 0 | -0.6 |
| D | 108.5 | 59 | 18 | 75.8 | 0 | -1.9 |
| E | 120.5 | 57 | 17 | 74.9 | 0 | -3.4 |
| F | 132.5 | 53 | 17 | 73.1 | 0 | -5.5 |
| G | 144.5 | 49 | 17 | 72.3 | 0 | -8.7 |
| H | 156.5 | 46 | 17 | 72.3 | 0 | -12.3 |
| I | 168.5 | 39 | 20 | 72.8 | 0 | -19.7 |

FIG.10

| SECTION (FRONT VIEW) | R (p.u.) | C (p.u.) | θ (deg) | ε (deg) | Y OFFSET (mm) | SKEW (adjusted) |
|---|---|---|---|---|---|---|
| A | 0.43 | 0.87 | 42 | 71.7 | 0 | 0.0 |
| B | 0.50 | 0.80 | 27 | 75.6 | 0 | 2.5 |
| C | 0.57 | 0.67 | 19 | 75.9 | 0 | 3.7 |
| D | 0.64 | 0.54 | 18 | 75.8 | 0 | 2.4 |
| E | 0.72 | 0.47 | 17 | 74.9 | 0 | 0.9 |
| F | 0.79 | 0.40 | 17 | 73.1 | 0 | -1.2 |
| G | 0.86 | 0.34 | 17 | 72.3 | 0 | -4.4 |
| H | 0.93 | 0.29 | 17 | 72.3 | 0 | -8.0 |
| I | 1.00 | 0.23 | 20 | 72.8 | 0 | -15.4 |

FIG.11

HIGH EFFICIENCY, LOW AXIAL PROFILE, LOW NOISE, AXIAL FLOW FAN

This is a continuation of copending application Ser. No. 07/884,968 filed on May 15, 1992, now abandoned.

FIELD OF THE INVENTION

This invention relates to one-piece fans of the type that are used in cooling modules of automotive vehicles for moving cooling air through heat exchangers of the vehicle, i.e. the engine radiator and/or the air conditioning condenser.

BACKGROUND AND SUMMARY OF THE INVENTION

From previously published patent documents, it is known to construct a one-piece fan that has a hub and a plurality of forwardly skewed blades that extend radially outwardly from the hub to a circular band that surrounds the hub. It is further known to dispose a shroud in surrounding relation to the fan band so that the fan rotates within the shroud.

It is also known to employ such a fan/shroud combination in a cooling module of an automotive vehicle, and in that case to construct the shroud with integral members that extend radially inwardly from the shroud to an integral electric motor mount for an electric motor that rotates the fan. These integral members are spaced axially from the fan blades so as to avoid mechanical interference therewith.

The design of any given automotive vehicle may impose dimensional constraints on a cooling module such that it may not be possible to use known axial flow fan constructions that possess high efficiency and low noise, for example where there is limited axial space for a fan. Accordingly, there is a need for a high efficiency, low noise axial flow fan that can be packaged within a space that is axially limited, and the present invention relates to the satisfaction of this need through novel and unique constructional features. Details of a specific example of a fan and shroud embodying principles of the invention will be hereinafter described with reference to the accompanying drawings. The drawings disclose a presently preferred embodiment according to the best mode contemplated at the present time for carrying out the invention.

BRIEF DESCRIPTION OF THE DRAWINGS

FIGS. 7–11 are views useful in describing the inventive fan.

DESCRIPTION OF THE PREFERRED EMBODIMENT

Figure 1:
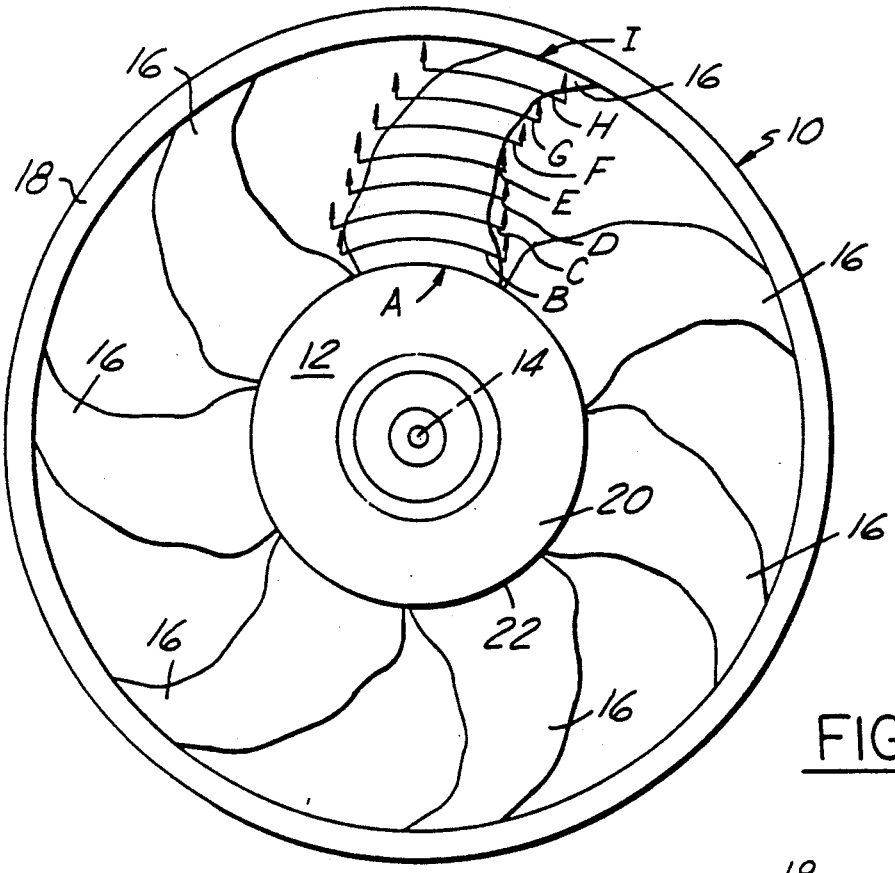
FIG. 1 is a front axial end view of a low axial profile fan embodying principles of the invention.
Figure 2:
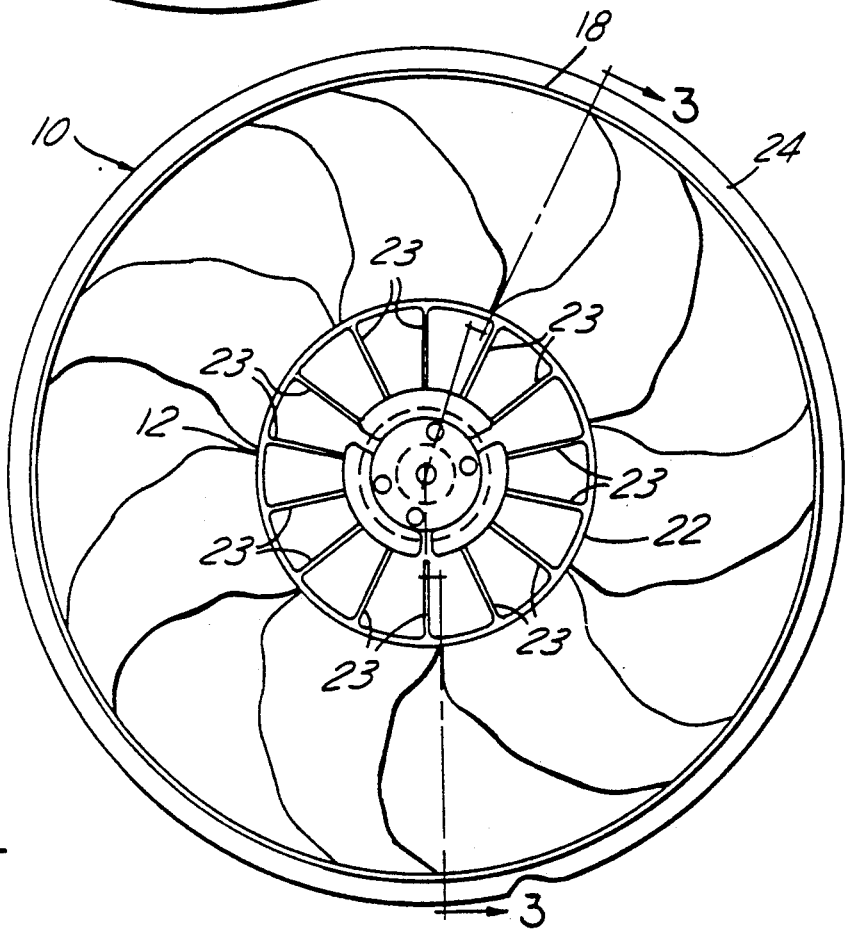
FIG. 2 is a rear axial end view of the fan of FIG. 1.
Figure 3:
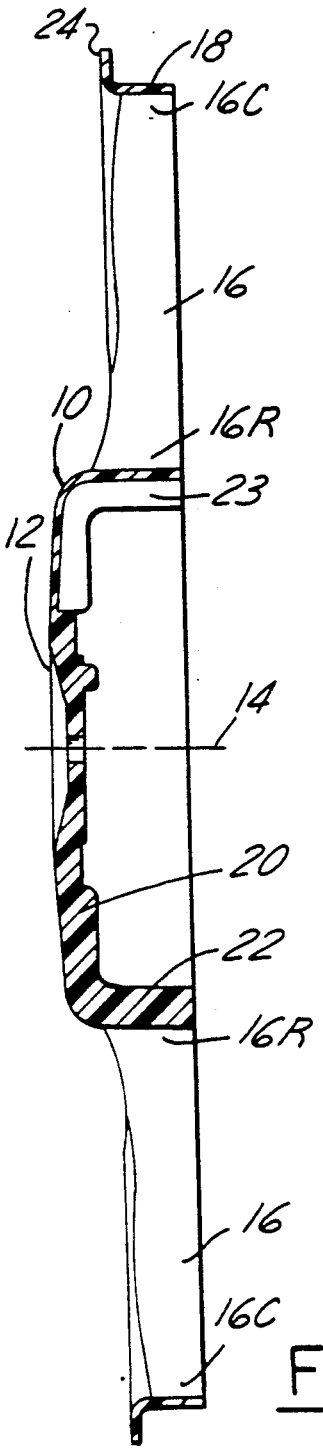
FIG. 3 is a cross sectional view in the direction of arrows 3—3 in FIG. 2.
Figure 5:
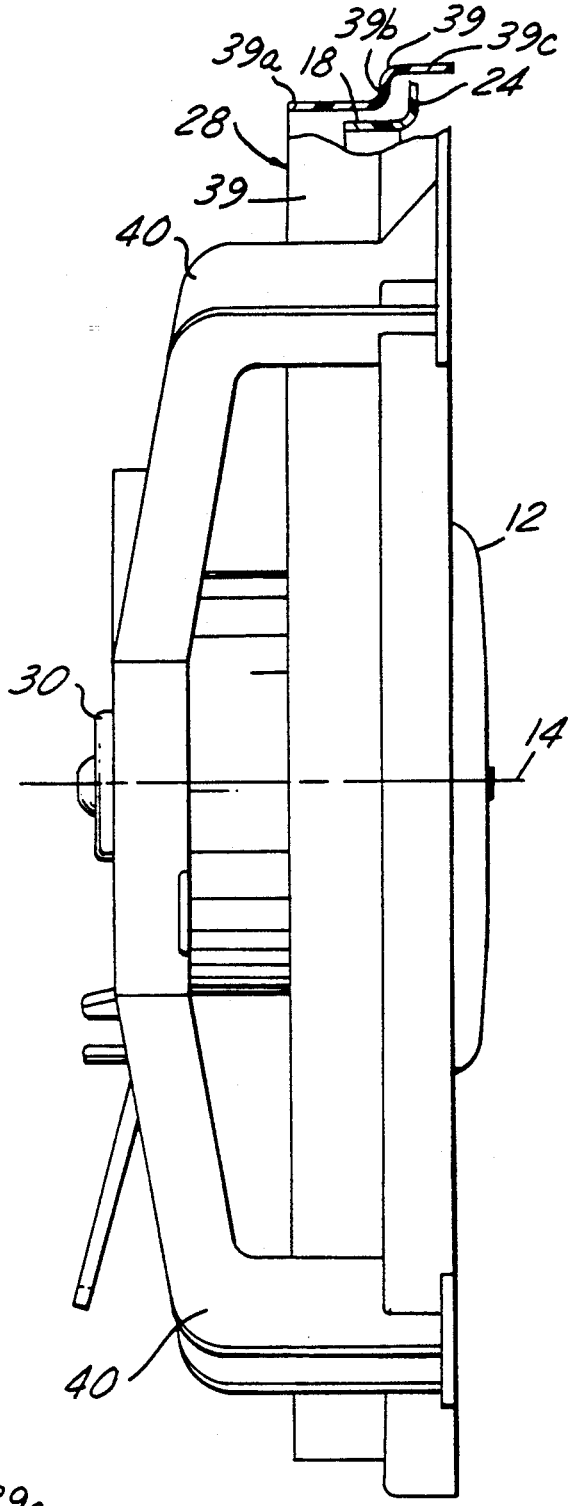
FIG. 5 is a right side elevational view of FIG. 4 with a portion sectioned away for illustrative purposes.
Figure 4:
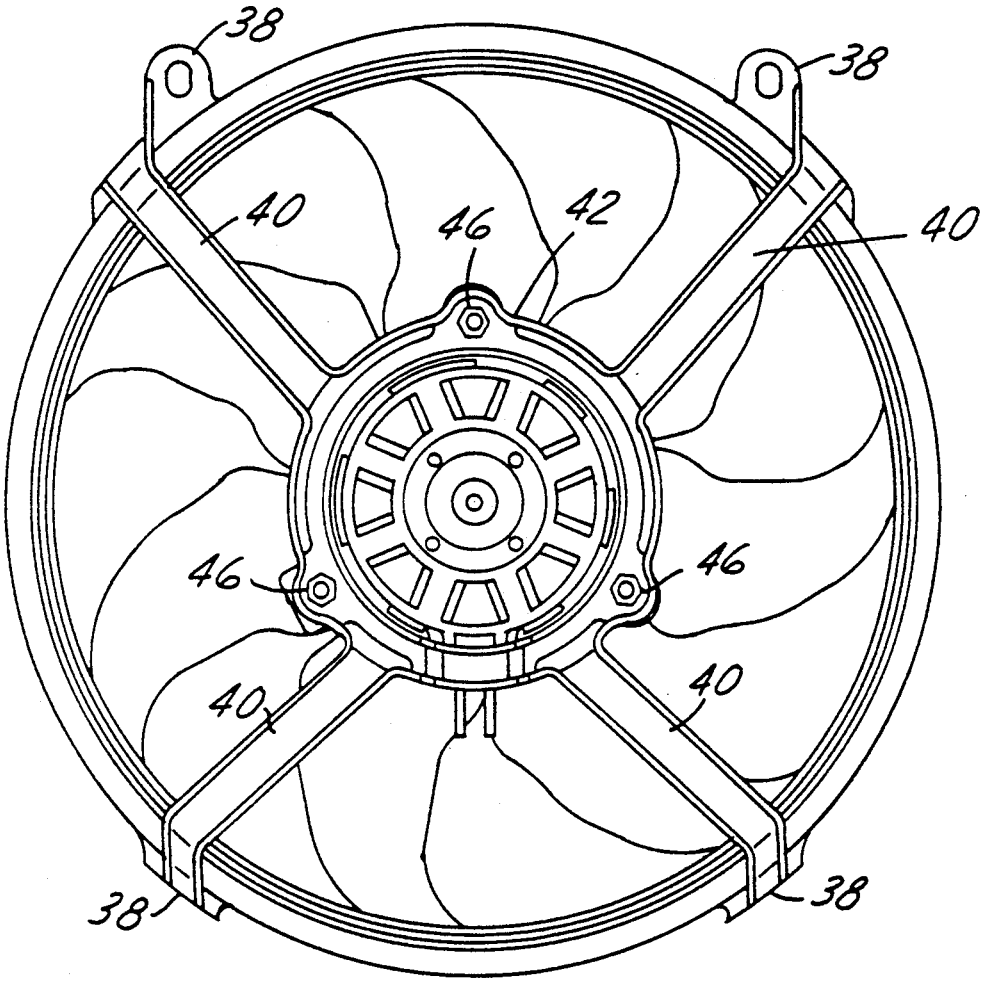
FIG. 4 is a rear axial end view of the fan in association with a shroud member.

FIGS. 1, 2, and 3 illustrate an exemplary one-piece high efficiency, low axial profile, low noise, axial flow fan 10 embodying principles of the invention. FIGS. 4 and 5 illustrate fan 10 in association with a one-piece shroud member 28. The fan and shroud member are fabricated by means of known processes using known materials.

Fan 10 comprises a hub 12 that supports the fan for rotation about an axis 14, a plurality of identical blades 16 (seven in the exemplary fan) symmetrically arranged around hub 12, and a circular outer band 18. A number (fourteen in the exemplary fan) of stiffening ribs 23 are integrally formed on the interior of the hub as shown.

Hub 12 comprises a circular end wall 20 and a circular side wall 22. At its center, end wall 20 is configured to provide accommodations for mounting of the fan to the shaft of an electric motor (hereinafter described).

Blades 16 are arranged in a uniform symmetrical pattern around the hub. Each blade is skewed and has a root 16R joining with side wall 22 of hub 12 and a crest 16C that joins with band 18.

Band 18 has a axial dimension equal to or just slightly greater than the axial dimension of each blade crest, and includes a radial flange 24 that extends outwardly at the axially forward edge of the band.

Band 18, including flange 24, circumferentially surrounds the hub, such that, as viewed in FIG. 3, a projection of the band onto axis 14 along a direction that is perpendicular to axis 14 fully intercepts the hub.

FIGS. 4–5 illustrate fan 10 in an operative association with shroud member 28, which also provides mounting for an electric motor 30 that powers the fan. When installed in an automotive vehicle to form a cooling module, the fan and shroud function to draw air through a heat exchanger structure (not shown) that is disposed in front of them. Such heat exchanger can represent either or both of the engine radiator and the air conditioning condenser. The points of attachment of shroud member 28 to the vehicle are designated by the numerals 38 in FIG. 4, and they will be subsequently explained in greater detail.

Shroud member 28 comprises a fan-surrounding portion 39 that is shaped for cooperation with band 18 and flange 24. The shroud also integrally comprises four members 40 that extend from the fan surrounding portion of the shroud to an integral mount 42 for electric motor 30. Motor 30 fastens to mount 42 at the three mounting locations designated by the reference numerals 46. The motor has a shaft (not shown) that points axially forwardly coaxial with axis 14, and the motor mounting accommodations in end wall 20 of hub 12 provide for the fan to be fitted onto and secured to the external end of the motor shaft so that the fan is rotated in unison with the rotation of the shaft when motor 30 is operated.

Members 40 are arranged to have other than a straight radial shape. They extend from fan-surrounding portion 39 of the shroud, first axially away from portion 39, and then both axially rearwardly and radially inwardly to mount 42.

The result of the constructions that have been described for both members 40 and blades 16 is that each blade is disposed sufficiently axially forwardly of each member along the radial extent of each blade that the passage of each blade past each member does not create unacceptably high turbulence that is detrimental to the desired objectives of high efficiency and low noise. The combination of the four members 40 as shown provides structural support for the motor mount, including the motor and fan.

Figure 6:
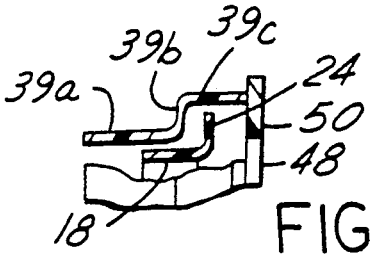
FIG. 6 is a fragmentary view in the vicinity of the sectioned away portion of FIG. 5 illustrating the association of the fan and shroud member with a further shroud member.

FIG. 6 depicts the association of fan 10 and shroud member 28 with a further shroud member 48. Shroud member 48 is a part of an automotive vehicle in which fan 10 and shroud member 28 are installed. Shroud member 48 comprises a wall portion 50 which is generally transverse to axis 14 and against which the forward edge of fan-surrounding portion 39 of shroud member 28 abuts. Fan surrounding portion 39 comprises a radially inner, axially extending wall portion 39*a* that merges axially forwardly with a radial wall portion 39*b*. Wall portion 39*b* extends radially outwardly from wall portion 39*a* to merge with a radially outer, axially extending wall portion 39*c* that extends axially forwardly from wall portion 39*b*. It is the forward edge of wall portion 39*c* that abuts wall portion 50 of shroud member 48.

These constructions and cooperative associations create a fan-surrounding structure having a radially inwardly open groove defined by wall portions 39*b*, 39*c*, and 50. It is within this groove that flange 24 is received. When the fan rotates, a labyrinth air seal is created, and it is quite effective in both attenuating fan efficiency losses due to recirculation and contributing to fan noise reduction.

The attachment of shroud member 28 to shroud member 48 is as follows. Shroud member 48 has an axial ledge extending axially rearwardly from wall portion 50. At a lower region that ledge contains a pair of slots. The lower two attachment points 38 of shroud member 28 are in the form of tabs that drop into these slots. The upper two attachment points are apertured and align with respective apertures in an upper region of shroud member 48. Respective fasteners are passed through the respective aligned apertures to fasten the two shroud members together.

Figure 7:
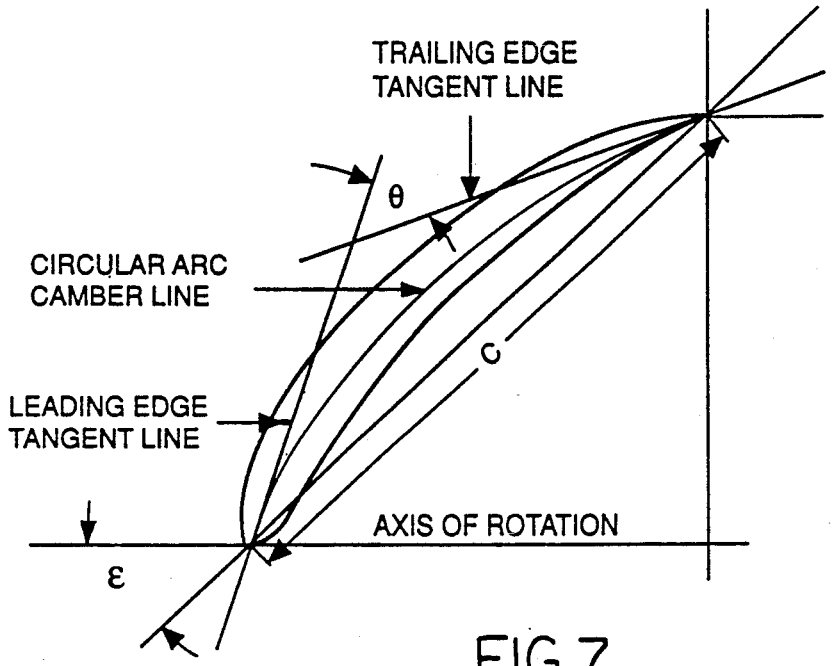
Figure 8:
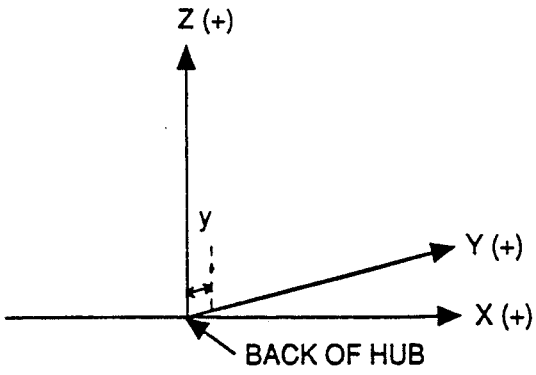
Figure 9:
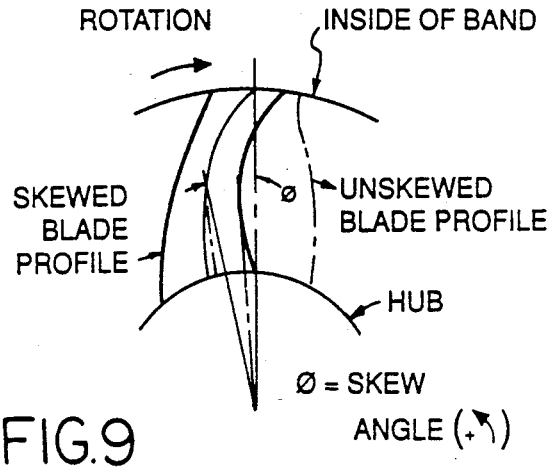

As shown in FIG. 7 each blade 16 has the shape of an airfoil that can be defined geometrically by several parameters. Some of these parameters are graphically portrayed in FIG. 7 in relation to a representative airfoil cross section while remaining parameters are graphically portrayed in FIGS. 8 and 9. In FIG. 7, the leading and trailing edge tangent lines are referenced with respect to the circular arc camber line. $\theta$ is the camber angle; $\epsilon$ is the stagger angle; and C is the straight line distance between the beginning and the end of the circular arc camber line (chord length). In FIG. 8, the Y-offset is the distance in the Y-direction between the back of the hub and the blade trailing edge (i.e. blade tail). For the specific example of fan that is illustrated in FIGS. 1-3, FIG. 10 provides specific numerical values of these parameters. FIG. 11 presents the parameters of FIG. 10 on a non-dimensional basis.

The airfoil-shaped cross section of a blade 16 is taken at a number of radial distances R as measured radially from axis 14. These radial distances are designated by the letters A-I in both FIGS. 1 and 8. The Y offset is the axial offset distance of the trailing edge of the circular arc camber line measured from the back of hub 12. Positive values of the Y offset are forward while negative values are rearward. As shown by FIG. 3, the axially rearward face of hub 12, the axially rearward edge of band 18 and the tails of blades 16 occupy a common plane that is perpendicular to axis 14.

The numerical values of the parameters defining each blade of the example provide noise attenuation at higher frequency bands. The fan and shroud of the invention provide high efficiency, low noise performance with a low axial profile for the fan.

What is claimed is:

1. A one-piece high efficiency, low axial profile, low noise, axial flow fan comprising a hub that is rotatable about an axis, a plurality of skewed, airfoil-shaped fan blades distributed circumferentially around said hub and extending both radially and axially away from said hub, each blade having a root joining with said hub, a circular band that is concentric with and spaced radially outwardly from said hub, each blade having a crest joining with said band, and wherein the axially rearward face of said hub, the axially rearward edge of said band and the tails of said blades occupy a common plane that is perpendicular to said axis, and in which each of said blades is constructed substantially in accordance with parameters defined as

| R (p.u.) | C (p.u.) | $\theta$ (deg.) | $\epsilon$ (deg) | Y OFFSET (mm) | SKEW (adjusted) |
|---|---|---|---|---|---|
| 0.43 | 0.87 | 42 | 71.7 | 0 | 0.0 |
| 0.50 | 0.80 | 27 | 75.6 | 0 | 2.5 |
| 0.57 | 0.67 | 19 | 75.9 | 0 | 3.7 |
| 0.64 | 0.54 | 18 | 75.8 | 0 | 2.4 |
| 0.72 | 0.47 | 17 | 74.9 | 0 | 0.9 |
| 0.79 | 0.40 | 17 | 73.1 | 0 | −1.2 |
| 0.86 | 0.34 | 17 | 72.3 | 0 | −4.4 |
| 0.93 | 0.29 | 17 | 72.3 | 0 | −8.0 |
| 1.00 | 0.23 | 20 | 72.8 | 0 | −15.4 |

wherein R(p.u.) is radial distance from axis as a function of the fan's radius, C(p.u.) is chord length of the blade's airfoil-shaped cross section at the corresponding radial distance as a fraction of the cross section's radial distance, $\theta$ is the camber angle of the cross section, $\epsilon$ is the stagger angle of the cross section, and Y-OFFSET is measured between the trailing edge of the cross section and the back of the hub.

2. A one-piece high efficiency, low axial profile, low noise, axial flow fan comprising a hub that is rotatable about an axis, a plurality of skewed, airfoil-shaped fan blades distributed circumferentially around said hub and extending both radially and axially away from said hub, each blade having a root joining with said hub, a circular band that is concentric with and spaced radially outwardly from said hub, each blade having a crest joining with said band, and wherein the axially rearward face of said hub, the axially rearward edge of said band and the tails of said blades occupy a common plane that is perpendicular to said axis, and in which each of said blades is constructed substantially in accordance with parameters defined as

| R (p.u.) | C (p.u.) | $\theta$ (deg.) | $\epsilon$ (deg) | Y OFFSET (mm) | SKEW (adjusted) |
|---|---|---|---|---|---|
| 72.5 | 63 | 42 | 71.7 | 0 | −4.3 |
| 84.5 | 68 | 27 | 75.6 | 0 | −1.8 |
| 96.5 | 65 | 19 | 75.9 | 0 | −0.6 |
| 108.5 | 59 | 18 | 75.8 | 0 | −1.9 |
| 120.5 | 57 | 17 | 74.9 | 0 | −3.4 |
| 132.5 | 53 | 17 | 73.1 | 0 | −5.5 |
| 144.5 | 49 | 17 | 72.3 | 0 | −8.7 |
| 156.5 | 46 | 17 | 72.3 | 0 | −12.3 |
| 168.5 | 39 | 20 | 72.8 | 0 | −19.7 |

wherein R(p.u.) is radial distance from axis, C(p.u.) is chord length of the blade's airfoil-shaped cross section at the corresponding radial distance, $\theta$ is the camber of the cross section, $\epsilon$ is the stagger angle of the cross section, and the Y-OFFSET is measured between the trailing edge of the cross section and the back of the hub.

* * * * *